US005573701A

United States Patent [19]

Bulfari et al.

[11] Patent Number: 5,573,701

[45] Date of Patent: Nov. 12, 1996

[54] LIQUID DETERGENT COMPOSITION

[75] Inventors: Mario Bulfari; Johannes C. Van De Pas, both of Vlaardingen, Netherlands

[73] Assignee: Lever Brothers Company, Division of Conopco, Inc., New York, N.Y.

[21] Appl. No.: 76,494

[22] Filed: Jun. 14, 1993

Related U.S. Application Data

[63] Continuation of Ser. No. 471,654, Jan. 22, 1990, abandoned, which is a continuation-in-part of Ser. No. 225,406, Jul. 28, 1988, abandoned.

[30] Foreign Application Priority Data

Jul. 31, 1987 [GB] United Kingdom ..... 718216
Jun. 9, 1988 [GB] United Kingdom ..... 8813689

[51] Int. Cl.[6] ..... C11D 3/395; C11D 3/37

[52] U.S. Cl. ..... 510/397; 510/434

[58] Field of Search ..... 252/135, 136, 252/174.14, 174.18, 174.24, 173, 540, DIG. 14, 174.23

[56] References Cited

U.S. PATENT DOCUMENTS

| | | | |
|---|---|---|---|
| 4,244,840 | 1/1981 | Straw | 252/540 |
| 4,326,965 | 4/1982 | Lips et al. | 252/8.8 |
| 4,452,717 | 6/1984 | Tai et al. | 252/109 |
| 4,597,889 | 7/1986 | Jones | 252/135 |
| 4,614,606 | 9/1986 | Machin et al. | 252/116 |
| 4,618,446 | 10/1986 | Haslop et al. | 252/135 |
| 4,642,198 | 2/1987 | Humpheys et al. | 252/94 |
| 4,715,969 | 12/1987 | Rothanavibhata et al. | 252/8.7 |
| 4,954,280 | 9/1990 | Elliott et al. | 252/90 |
| 5,006,273 | 4/1991 | Machin et al. | 252/174.23 |
| 5,024,776 | 6/1991 | Kreischer | 252/97 |
| 5,108,644 | 4/1992 | Machin et al. | 252/174.23 |
| 5,147,576 | 9/1992 | Montague et al. | 252/174 |
| 5,160,650 | 11/1992 | Donker et al. | 252/95 |
| 5,205,957 | 4/1993 | Van de Pas | 252/173 |

FOREIGN PATENT DOCUMENTS 2168717 6/1986 United Kingdom .

*Primary Examiner*—Paul Lieberman
*Assistant Examiner*—Kery Fries
*Attorney, Agent, or Firm*—Ronald A. Koatz

[57] ABSTRACT

Enhanced levels of viscosity reducing polymer can be stably incorporated in liquid detergent compositions of the kind comprising a structured phase containing detergent active material dispersed in an aqueous phase containing dissolved electrolyte, if the polymer is only partly dissolved in the latter phase.

13 Claims, 1 Drawing Sheet

LIQUID DETERGENT COMPOSITION

Figure 1:
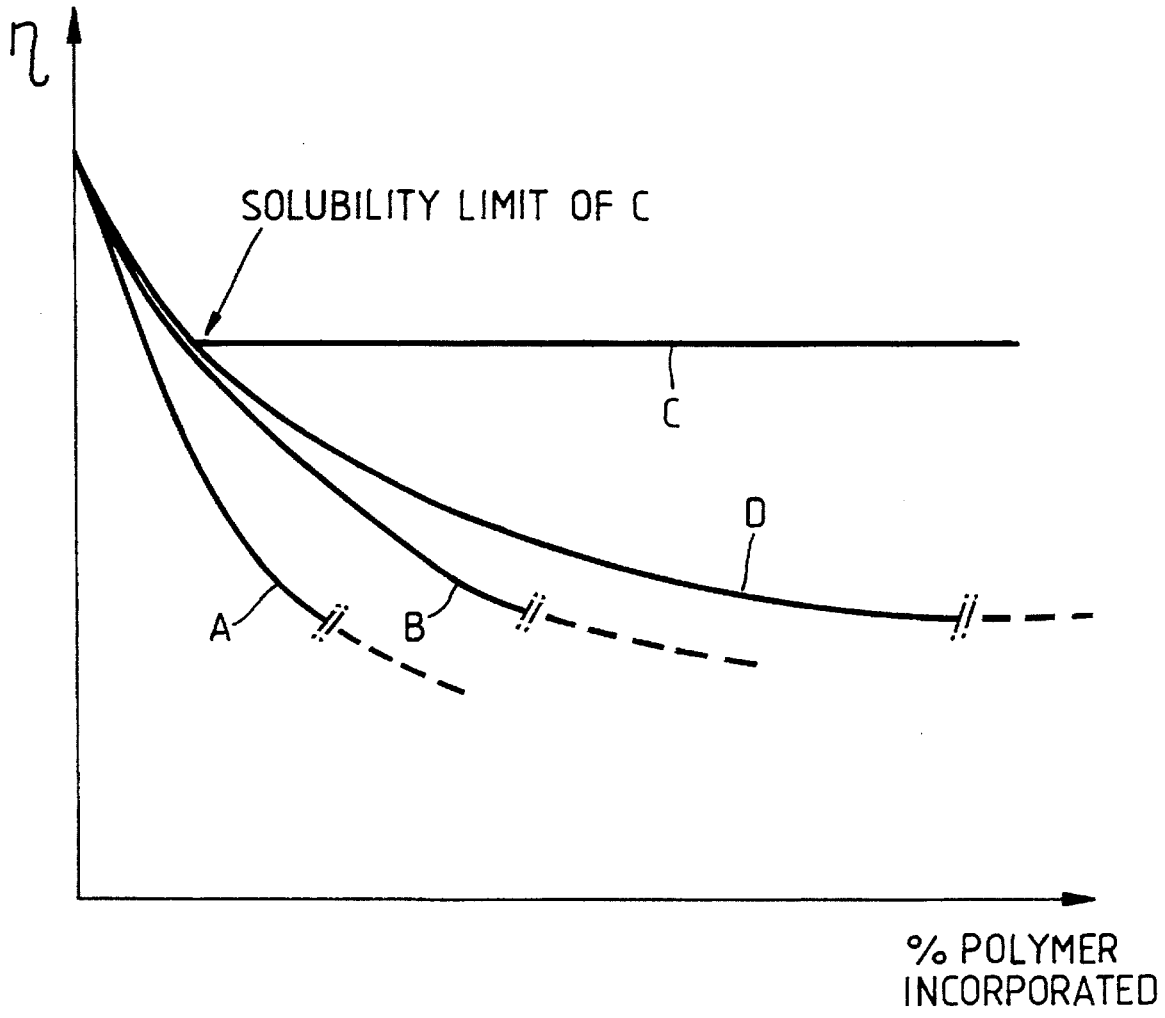

This is a continuation of application Ser. No. 07/471,654, filed Jan. 22, 1990, which in turn is a continuation-in-part of U.S. Ser. No. 225,406, filed Jul. 28, 1988, both now abandoned.

The present invention is concerned with liquid detergent compositions of the kind containing a structure formed from detergent active material, the active structure existing as a separate phase dispersed within predominantly aqueous continuous phase. This aqueous phase usually contains dissolved electrolyte.

Such structuring is very well known in the art and may be deliberately brought about to endow properties such as consumer preferred flow properties and/or turbid appearance. Many active-structured liquids are also capable of suspending particulate solids such as detergency builders and abrasive particles.

Some of the different kinds of active-structuring which are possible are described in the reference H. A. Barnes, 'Detergents' Ch 2 in K. Walters (Ed), 'Rheometry: Industrial Applications' J Wiley & Sons, Letchworth 1980. In general, the degree of ordering of such systems increases with increasing surfactant and/or electrolyte concentrations. At very low concentrations, the surfactant can exist as a molecular solution, or as a solution of spherical micelles, both of these being isotropic. With the addition of further surfactant and/or electrolyte, structured (anisotropic) systems can form. They are referred to respectively, by various terms such as rod-micelles, planar lamellar structures, lamellar droplets and liquid crystalline phases. Often, different workers have used different terminology to refer to the structures which are really the same. For instance, in European patent specification EP-A-151 884, lamellar droplets are called 'spherulites'. The presence and identity of a surfactant structuring system in a liquid may be determined by means known to those skilled in the art for example, optical techniques, various rheometrical measurements, x-ray or neutron diffraction, and sometimes, electron microscopy.

One common such type of internal surfactant structure is a dispersion of lamellar droplets (lamellar dispersion). These droplets consist of an onion-like configuration of concentric bilayers of surfactant molecules, between which is trapped water or electrolyte solution (aqueous phase). Systems in which the droplets are close-packed provide a very desirable combination of physical stability and solid-suspending properties with useful flow properties.

Electrolyte may be only dissolved in the aqueous continuous phase or may also be present as suspended solid particles. Particles of solid which are insoluble in the aqueous phase may be suspended alternatively or in addition to any solid electrolyte particles.

Three common product forms are liquids for heavy duty fabrics washing as well as liquid abrasive and general purpose cleaners. In the first class, the suspended solid can be substantially the same as the dissolved electrolyte, being an excess of same beyond the solubility limit. This solid is usually present as a detergency builder, i.e. to counteract the effects of calcium ion water hardness in the wash. In addition, it may be desirable to suspend substantially insoluble particles of bleach, for example diperoxydodecandioic acid (DPDA). In the second class, the suspended solid is usually a particulate abrasive, insoluble in the system. In that case the electrolyte is a different, water soluble material, present to contribute to structuring of the active material in the dispersed phase. In certain cases, the abrasive can however comprise partially soluble salts which dissolve on dilution of the product. In the third class, the structure is used for thickening products to give consumer-preferred flow properties and sometimes to suspend pigment particles. Compositions of the first kind are described, for example, in our patent specification EP-A-38,101; compositions containing suspended DPDA bleach are disclosed in specification EP-A-160 342. Examples of those in the second category are described in our specification EP-A-104,452. Those in the third category are described, for example, in U.S. Pat. No. 4,244,840.

Two problems are commonly encountered when formulating liquids with solids suspended by these systems, especially lamellar droplets. The first is high viscosity, rendering the products difficult to pour and the second is instability, i.e. a tendency for the dispersed and aqueous phases to separate upon storage at elevated, or even ambient temperatures. Thus care must always be exercised when formulating such liquids so that the nature and concentration of the actives and electrolyte are selected to give the required rheological properties.

However, these formulation techniques are always an exercise in balancing the intended rheology and stability with the ideal ingredients in the formulation and some combinations will not be practicable. One example is when one wishes to make a concentrated product in which the total amount of detergent actives is relatively high in proportion to the other components. The main problem which usually manifests itself here is an unacceptable rise in viscosity.

One approach to viscosity control in general is to formulate the liquids to be shear-thinning, i.e. accepting the high viscosity of the product at rest in a bottle but devising the composition such that the action of pouring causes shear beyond the yield point, so that the product then flows more easily. This property is utilised in the compositions described in our aforementioned specification EP-A-38,101. Unfortunately, it has been found that this cannot easily be utilised for all theoretically possible combinations of ingredients, for example in liquids with high levels of active.

It is also known that incorporation of fabric softening clays, (e.g. bentonires) in liquids can give rise to unacceptably high viscosity. One approach to mitigate this disadvantage has been to also incorporate a small amount of a dissolved low molecular weight polyacrylate. This is described in UK patent specification GB-A-2,168,717. However, if one wishes to use such polymers for viscosity control in the widest possible range of structured liquids, then one is led on occasions to try to incorporate more and more polymer. Alternatively or additionally to this reason, there is also a desire to use increased amounts of polymers for their detergency builder properties, i.e to counter the effects of calcium ion water hardness. This is particularly important when one wishes to substitute the polymers for conventional phosphate builders (either in whole or in part) for environmental reasons.

Unfortunately, when it is attempted to dissolve more polymer, what is then frequently found (as when trying to incorporate increased amounts of any component in a structured liquid) is an increased tendency to instability, i.e. to separate into two or more different phases.

The applicants though, have further discovered that where such instability occurs, it is possible to extend the amount of polymer which can be incorporated stably, by adjusting the composition such that only part of the polymer is in solution whilst the rest is incorporated in a stable 'non-dissolved' phase within the composition.

Thus, the present composition provides a liquid detergent composition comprising a structured phase containing detergent active material, dispersed in an aqueous phase containing dissolved electrolyte, and a viscosity reducing polymer, the electrolyte containing aqueous phase being such that the polymer is only partly dissolved therein. Specifically, as shown in the examples, the polymer is dissolved in the electrolyte containing phase at a level of about 8% to about 49% by weight.

In preferred embodiments, such compositions are sufficiently stable so as only to yield 2% or less phase separation upon storage for 21 days at 25° C. although sometimes, somewhat less stability may be tolerable.

It is also possible to incorporate larger amounts of polymer without instability and still achieve an acceptably low viscosity, preferably 1 Pas or less at a shear rate of $21s^{-1}$, although sometimes, slightly higher viscosities may be acceptable.

Although not wishing to be bound by any interpretation or theory, one explanation the applicants propose for this effect is that the observed undesirable early onset of instability referred to above is due to the fact that the conditions in the liquid minus the polymer are such that as more polymer is added, viscosity decreases but then there is a sudden onset of lack of solubility, beyond which no more will dissolve.

This may be illustrated schematically by the curve A in the accompanying FIG. 1. The broken line indicates the onset of instability, whereafter there is instability. However, all polymer samples do not contain molecules of identical configuration and molecular weight, but a spectrum of molecules with varying degrees of polymerisation (and in the case of co-polymers, proportions of different components). To oversimplify the applicants' theory, the present invention may be due to adjustment of conditions in the liquid until one broad category of the polymers remains soluble at much higher concentrations than another. In FIG. 1, curve B represents the category which under these particular conditions (different from those for curve A) can remain soluble at higher concentrations, whereas those molecules which become non-dissolved at much lower concentrations are shown as curve C. It is as though the polymer can then be incorporated stably as represented by curve D. This is clearly an over-simplification since it is unlikely that under any set of conditions, the polymer sample could be crudely classified into two such broad categories. In practice, there is more likely to be a continuum of the effect. Nevertheless, this simplified explanation serves to illustrate the proposed phenomenon.

The applicants believe that those molecules which are not dissolved (curve C) whilst the others remain in solution (curve B), are held in a suspended precipitated phase, dispersed within the structured liquid. Evidence suggestive of this phenomenon has been obtained by electron microscopy.

Put another way, the invention entails changing a composition of the kind described above, having an early onset of instability with increasing polymer concentration, to bring about the effect described above. This means that effectively, one could say that the amount of polymer stably incorporated in a composition according to the present invention is greater than that in a reference composition in which at least one parameter thereof is varied from that in the said composition, to permit the maximum amount of polymer to be incorporated by substantially all being dissolved, beyond which amount, dissolving of more polymer would cause the reference composition to have a phase separation of 2% or greater upon storage at 25° C. for 21 days.

The parameter to be varied in the composition to bring about this effect may be pH, the quantity or nature of electrolyte in the composition or occasionally the quantity or nature of the detergent active material, or other parameters.

The viscosity reducing polymers which are susceptible of use in the present invention are selected from a very wide range and in particular include those polymer and co-polymer salts known as detergency builders. For example, may be used (including building and non-building polymers) polyethylene glycols, polyacrylates, polymaleates, polysugars, polysugarsulphonates and co-polymers of any of these. In some preferred embodiments, the polymer comprises a co-polymer which includes an alkali metal salt of a polyacrylic, polymethacrylic or maleic acid or anhydride. Preferably, compositions with these co-polymers have a pH of above 8.0. In general, the amount of viscosity reducing polymer can vary widely according to the formulation of the rest of the composition. However, typical amounts are from 0.5 to 4.5% by weight, for example from 1 to 3.5% by weight.

In some embodiments of the present invention it is further preferred to also include a second polymer which is substantially totally soluble in the aqueous phase and has an electrolyte resistance of more than 5 grams sodium nitrilotriacetate in 100 ml of a 5% by weight aqueous solution thereof, said second polymer also having a vapour pressure in 20% aqueous solution, equal to or less than the vapour pressure of a reference 2% by weight or greater aqueous solution of polyethylene glycol having an average molecular weight of 6000; said second polymer having a molecular weight of at least 1000. Mixtures of such second polymers may also be used.

The incorporation of the second polymer permits formulation with improved stability at the same viscosity (relative to the composition without the second polymer) or lower viscosity with the same stability. The second polymer can also reduce an upwards viscosity drift, even when it also brings about a viscosity reduction.

It is especially preferred to incorporate the second polymer when the (first) viscosity reducing polymer has a large insoluble component. That is because although the building capacity of the first polymer will be good (since relatively high quantities can be stably incorporated), the viscosity reduction will not be optimum (since little will be dissolved). Thus, the second polymer can usefully function to reduce the viscosity further, to an ideal level.

We prefer that the second polymer is incorporated at from 0.05 to 20% by weight, most preferably from 0.1 to 2.5% by weight, and especially from 0.2 to 1.5% by weight of the total composition. In many compositions (but not all) levels above these can cause instability. A large number of different polymers may be used as such a second polymer, provided the electrolyte resistance and vapour pressure requirements are met. The former is measured as the amount of sodium nitrilotriacetate (NaNTA) solution necessary to reach the cloud point of 100 ml of a 5% solution of the polymer in water at 25° C., with the system adjusted to neutral pH, i.e. about 7. This is preferably effected using sodium hydroxide. Most preferably, the electrolyte resistance is 10 g NaNTA, especially 15 g. The latter indicates a vapour pressure low enough to have sufficient water binding capability, as generally explained in the applicants' specification GB-A-2 053 249. Preferably the measurement is effected with a reference solution at 10% by weight aqueous concentration, especially 18%.

Typical classes of polymers which may be used as the second polymer, provided they meet the above requirement, include polyethylene glycols, Dextran, Dextran sulphonates, polyacrylates and polyacrylate/maleic acid co-polymers. Whether a given polymer is only partly, or substantially totally soluble in the total system will depend on the other components, in particular, the amount and type of electrolyte material.

The second polymer must have an average molecular weight of at least 1000 but a minimum average molecular weight of 2000 is preferred. Typical average molecular weight ranges resulting in beneficial viscosity control are from 1,200 to 30,000 especially from 5,000 to 30,000.

The detergent active material may be any known in the art for forming structured liquids and in general may be selected from one or more of anionic, cationic, nonionic, zwitterionic and amphoteric surfactants. However, one preferred combination comprises:

a) a nonionic surfactant and/or polyalkoxylated anionic surfactant; and b) a non-polyalkoxylated anionic surfactant.

In some embodiments, the actives may also include an alkali metal soap of a fatty acid, preferably one containing 12 to 18 carbon atoms. Typical such acids are oleic acid, ricinoleic acid and fatty acids derived from castor oil, rapeseed oil, groundnut oil, coconut oil, palmkernal oil or mixtures thereof. The sodium or potassium soaps of these acids can be used, the potassium soaps being preferred.

Suitable nonionic surfactants which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The anionic surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

The compositions of the invention preferably contain a detergency builder material. This may be any material capable of reducing the level of free calcium ions in the wash liquor and will preferably provide the composition with other beneficial properties such as the generation of an alkaline pH, the suspension of soil removed from the fabric and the dispersion of the fabric softening clay material. They may be classed as inorganic, organic non-polymeric and organic polymeric.

Generally, we prefer that any inorganic builder comprises all or part of the electrolyte (provided water soluble). We also prefer that the liquid contains suspended solids, especially as all or part of the builder (which in that case does not have to be water soluble). The electrolyte will generally form from 1 to 60% by weight of the total composition. In some preferred embodiments, the suspended solids comprise water-insoluble amorphous or crystalline aluminosilicates, since these liquids tend to induce high viscosity and are thus in need of viscosity reduction by the polymer. As previously mentioned, very often the polymer will itself be a builder and so together with the zeolite forms a very useful phosphorus-free builder system.

However, examples of phosphorus-containing inorganic detergency builders, when present, include the water-soluble salts, especially alkaline metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic detergency builders, when present, include water-soluble alkali metal carbonates, bicarbonates, silicates and crystalline and amorphous alumino silicates. Specific examples include sodium carbonate (with or without calcite seeds), potassium carbonate, sodium and potassium bicarbonates and silicates.

Examples of non-polymeric organic detergency builders, when present, include the alkaline metal, ammonium and substituted ammonium polyacetates, carboxylates, polycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

Apart from the ingredients already mentioned, a number of optional ingredients may also be present, such as lather boosters, e.g alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and, usually present in very minor amounts, fluorescent agents, perfumes, enzymes such as proteases, lipases (e.g. Lipolase (Trade Mark) ex Novo), and amylases, germicides, colourants and fabric softening clay materials.

The compositions of the present invention may be prepared using the general techniques known in the art of the processing of liquid detergent products. However, the order of addition of components can be important. Thus, one preferred order of addition (with continuous mixing) is to add to the water, the soluble electrolytes, then any insoluble material such as aluminosilicates, followed by the polymer and then the actives, which may be mixed before being added to the electrolyte/water phase. Another preferred order of addition is to add to the water, any insoluble material such as aluminosilicates, the partly soluble polymer and then the detergent active material, followed by the electrolyte. The mixture is then cooled below 30° C., whereafter any minors and additional ingredients can be added. The second polymer (if any) is added to reduce the viscosity to the desired level and it is indeed often possible to 'titrate' the viscosity to the required level by progressive addition of the second polymer. Finally, if necessary, the pH of the composition can be adjusted further, e.g. by the addition of a small quantity of caustic material.

TABLE 1

The following compositions were prepared and had stability and viscosity as shown.

| Component | Composition (% w/w) I | $II_1$ | $II_2$ | $II_3$ | III | IV |
|---|---|---|---|---|---|---|
| Na LAS | 7.7 | 8.4 | 8.4 | 8.4 | 8.8 | 9.2 |
| LES | 2.4 | 3.0 | 3.0 | 3.0 | 4.8 | 5.0 |
| Nonionic (1) | 2.4 | 2.6 | 2.6 | 2.6 | 3.1 | 3.3 |
| Zeolite | 20.0 | 16.0 | 16.0 | 16.0 | — | — |
| Polymer Builder (1) | 3.5 | 3.5 | 3.5 | var | 4.2 | — |
| Citric Acid | 1.5 | 1.6 | 1.6 | 1.6 | 1.9 | 2.0 |
| Glycerol | 8.0 | 7.0 | 7.0 | 7.0 | 8.4 | 8.8 |
| Borax | 5.7 | 6.0 | 6.0 | 6.0 | 7.2 | 7.5 |
| $CaCl_2$ | 0.3 | 0.25 | 0.25 | 0.25 | — | — |
| Enzyme | 0.5 | 0.5 | 0.5 | 0.5 | — | — |
| Fluorescer | 0.05 | 0.04 | 0.04 | 0.04 | — | — |
| Silicone | 0.35 | — | — | — | — | — |
| Perfume | 0.2 | 0.23 | 0.23 | 0.23 | — | — |
| NaOH to adjust the pH to | 8.5 | 7.8 | 8.8 | 8.8 | var | var |
| Water | — | — | up to 100 | — | — | — |
| Stability | stable | unstable | stable | var | var | |
| Viscosity (mPaS) at 21 $s^{-1}$ | 800 | — | 750–1050 | var see Table 2 | var see Table 3 | |
| % dissolved polymer by weight | 17% | 100% | 21% | | | |

The invention will now be illustrated by the following non-limiting examples.

Raw Material Specification

The following definitions apply throughout the Examples. Unless indicated to the contrary, all percentages are by weight.

Actives

Na LAS=Na-Dodecyl benzene sulphonate

LES=Lauryl Ether Sulphate (Approx 3EO)

Nonionic (1)=ethoxylated fatty alcohol ($C_{13-15}EO_3$)

Nonionic (2)=ethoxylated fatty alcohol ($C_{13-15}EO_7$)

Main Viscosity Reducing Polymers

Polymer Builder (1)=Co-polymer of Acrylate and Maleate sodium salt, maleic acid: acrylic acid approx 3.8:1, average MW about 70,000.

Polymer Builder (2)=Co-polymer of Acrylate and Maleate sodium salt, maleic acid: acrylic acid approx 1.6:1, average MW about 50,000.

"Second" Polymers

| | |
|---|---|
| (1) | Na-polyacrylate, average MW about 1,200 |
| (2) | Na-polyacrylate, average MW about 2,500 |
| (3) | Na-polyacrylate, average MW about 5,000 |
| (4) | Na-polyacrylate, average MW about 8,000 |
| (5) | Na-polyacrylate, average MW about 15,000 |
| (6) | Na-polyacrylate, average MW about 30,000 |

Minors

Enzyme=proteolytic type

The parameters marked 'var' were varied and the results of stability and viscosity measurements are shown in Tables 2 and 3 respectively. In the context of these Examples 'stable' means not showing more than 2% phase separation at ambient temperature (ca 21°–25° C.) over three months. 'Unstable ' is to be construed accordingly.

TABLE 2

Effect of Polymer Concentration Composition $II_3$

| Polymer Builder (1) (% w/w) | Stability | Viscosity (mPaS) at 21 $s^{-1}$ | % dissolved polymer by weight |
|---|---|---|---|
| 0 | Stable | 2400 | — |
| 0.6 | Stable | 2500 | not determined |
| 1 | Stable | 950 | 22% |
| 2 | Stable | 1050 | 22% |
| 3 | Stable | 1050 | not determined |
| 4 | Stable | 1300 | 22% |
| 5 | Unstable | 1450 | 22% |

These results show that without polymer, the viscosity of the product is too high for it to be readily pourable. It is clear that up to 4% polymer can be stably incorporated in these compositions in which the polymer is only partly dissolved (cf Table 4 below). In reference composition $II_1$ the polymer is completely dissolved (i.e., dissolved at a level of 100% by weight) at 3.5% but already the composition is unstable.

TABLE 3

Variation with pH of Solubility of Polymer Builder (1) and Stability of Total System

| Composition | pH | Stability | Viscosity (mPaS) at 21 $s^{-1}$ | % dissolved polymer by weight |
|---|---|---|---|---|
| III | 7.0 | Unstable | 120 | 100% |
| III | 7.5 | Unstable | 160 | 100% |
| III | 8.0 | Unstable | 270 | 64% |
| III | 8.4 | Stable | 230 | 38% |
| III | 9.1 | Stable | 180 | 21% |
| IV | 7.0 | Stable | 660 | — |
| IV | 7.5 | Stable | 700 | — |
| IV | 8.0 | Stable | 720 | — |
| IV | 8.4 | Stable | 770 | — |
| IV | 9.1 | Stable | 870 | — |

These results demonstrate that viscosity is reduced by incorporation of polymer (composition III) but that when the polymer (4.2%) is all dissolved pH<8.0), instability results. These viscosities are all lower than those in Tables 1 and 2 because of the absence of zeolite.

TABLE 4

Existence of Stable Incorporation of Partly Dissolved Polymer Builder (1) - Variation with pH

| Composition | Parts |
|---|---|
| Water | 491 |
| Glycerol | 70 |
| Borax | 60 |
| NaOH | 10 |
| Citric acid | 16 |
| Polymer Builder (as Table 1) | 3.5 |

| pH adjusted to | Appearance* | % polymer rich phase** |
|---|---|---|
| 7.80 | clear | 0 |
| 7.95 | just turbid | — |
| 8.01 | turbid | 4.5 |
| 8.36 | turbid | 8 |
| 8.77 | turbid | 10 |
| 9.23 | turbid | 10 |
| 9.61 | turbid | 10 |

*just after preparation
**after 4 days storage

These figures show that below a pH of 7.95, all polymer is dissolved as evidenced by a clear appearance. Above that pH, the polymer exists also in a polymer-rich 'non-dissolved' phase.

TABLE 5

The following compositions were prepared and had stability and viscosity as shown in Tables 6–8.

| Component | Composition (% w/w) V | VI | VII | VIII |
|---|---|---|---|---|
| NaLAS | 7.3 | 7.3 | 7.3 | 7.6 |
| LES | 4.0 | 4.0 | 4.0 | 4.2 |
| Nonionic | 2.6 | 2.6 | 2.6 | 2.7 |
| Zeolite | 16.0 | 16.0 | 16.0 | 16.6 |

TABLE 5-continued

The following compositions were prepared and had stability and viscosity as shown in Tables 6–8.

| Component | Composition (% w/w) V | VI | VII | VIII |
|---|---|---|---|---|
| Polymer Builder (1) | var | — | 3.5 | — |
| Polymer Builder (2) | — | var | — | — |
| Citric acid | 1.6 | 1.6 | 1.6 | 1.7 |
| Glycerol | 7.0 | 7.0 | 7.0 | 7.3 |
| Borax | 6.0 | 6.0 | 6.0 | 6.3 |
| NaOH to adjust the pH to | var | 8.4 | var | var |
| Water | up to 100 | | | |
| Stability | var | var | var | var |
| Viscosity | see Table 6 | see Table 7 | see Table 8 | see Table 8 |

The parameters marked "var" were varied and the results of stability and viscosity measurement are shown in Tables 6–8. In the context of these examples, "stable" means not showing more than 2% phase separation at ambient temperature (±21°–25° C.) over three months. "Unstable" is to be construed accordingly.

TABLE 6

Effect of Polymer concentration and pH on Composition V

| Polymer Builder (1) % w/w | pH | Stability | Viscosity mPas at 21 $s^{-1}$ | % dissolved polymer by weight |
|---|---|---|---|---|
| 0 | 7.8 | Stable | 1510 | — |
| 1 | 7.8 | " | 1180 | 100% |
| 2 | 7.8 | " | 850 | 100% |
| 3 | 7.8 | Unstable | 770 | 100% |
| 3.5 | 7.8 | " | 730 | 100% |
| 0 | 8.9 | Stable | 1610 | — |
| 1 | 8.9 | " | 1470 | 21% |
| 2 | 8.9 | " | 1220 | 21% |
| 3 | 8.9 | " | 650 | 21% |
| 3.5 | 8.9 | " | 670 | 21% |

These results show that without polymer, the viscosity of the product is too high for it to be readily pourable. It is clear that at least 3.5% polymer can be stably incorporated in these compositions (pH=8.9) in which the polymer is only partly dissolved (cf Table 4 above). In reference compositions at a pH of 7.8, the polymer is completely dissolved and becomes already unstable at 3% polymer.

TABLE 7

Effect of Polymer concentration on Composition VI

| Polymer Builder (2) (% w/w) | Stability | Viscosity mPas at 21 $s^{-1}$ | % dissolved polymer by weight |
|---|---|---|---|
| 0 | Stable | 1450 | — |
| 0.5 | " | 1270 | 8% |
| 1 | " | 1120 | 8% |
| 2 | " | 1270 | 8% |
| 3 | " | 1150 | 8% |
| 3.5 | " | 1060 | 8% |

This table shows that also with Polymer Builder (2), a viscosity reduction is obtained (so pourability is increased) while maintaining a stable product. Under these conditions (pH 8.4) the Polymer Builder is only partly dissolved i.e., dissolved at a level of 8% by weight.

TABLE 8

Variation of pH on Polymer Solubility and Stability when Zeolite present in formulations

| Composition | pH | Stability | Viscosity mPas at 21 $s^{-1}$ | % dissolved polymer by weight |
|---|---|---|---|---|
| VII | 7.4 | Unstable | 930 | 100% |
| VII | 7.6 | Unstable | 960 | 100% |
| VII | 8.2 | Stable | 660 | 49% |
| VII | 8.7 | Stable | 950 | 21% |
| VII | 9.1 | Stable | 840 | 21% |
| VIII | 7.3 | Stable | 1760 | — |
| VIII | 7.8 | Stable | 1550 | — |
| VIII | 8.2 | Stable | 1460 | — |
| VIII | 8.7 | Stable | 1520 | — |
| VIII | 9.3 | Stable | 1410 | — |

These results demonstrate that viscosity is reduced by incorporation of polymer (VIII–VII) but that when the polymer (3.5%) is all dissolved (pH≦8.0), instability results.

TABLE 9

The following compositions were prepared and had stability and viscosity as shown in Tables 10–13.

| Component | Composition (% w/w) IX | X | XI | XII |
|---|---|---|---|---|
| NaLAS | 7.2 | 6.6 | 7.2 | 6.6 |
| LES | 2.3 | 2.4 | 2.4 | 3.0 |
| Nonionic (1) | 2.3 | — | 2.4 | 2.4 |
| Nonionic (2) | — | 3.0 | — | — |
| Zeolite | 20 | 20 | 20 | 20 |
| Polymer Builder (1) | 3.0 | — | — | — |
| Polymer Builder (2) | — | 2.5 | 2.5 | 2.5 |
| Citric acid | 1.5 | 1.5 | 1.5 | 1.5 |
| Glycerol | 8.0 | 8.0 | 8.0 | 8.0 |
| Borax | 5.7 | 5.7 | 5.7 | 5.7 |
| $CaCl_2$ | 0.15 | 0.15 | — | — |
| Enzyme | 0.28 | 0.28 | — | — |
| Fluorescer | 0.05 | 0.05 | — | — |
| Silicone | 0.35 | 0.35 | — | — |
| Perfume | 0.3 | 0.3 | — | — |
| NaOH to adjust the pH to | 8.6 | 8.6 | 8.6 | 8.6 |
| "Second" polymer | var | var | var | var |
| Water | | ← up to 100 → | | |
| Stability | var | var | var | var |
| Viscosity | see Table 10 | see Table 11 | see Table 12 | see Table 13 |

The parameters marked "var" were varied and the results of stability and viscosity measurements are shown in Tables 10–13. In the context of these examples, "stable" means not showing more than 2% phase separation at ambient temperature (+/– 21°–25° C.) over three months. "Unstable" is to be construed accordingly.

TABLE 10

Effect of "second" polymer (2) on viscosity of Composition IX

| "Second" polymer | Viscosity mPas at 21 $s^{-1}$ after storage | | | | |
|---|---|---|---|---|---|
| (2) | direct | 1 week | 2 weeks | 3 weeks | Stability |
| 0% | 670 | 1140 | 1340 | 1220 | Stable |
| 0.2% | 400 | 720 | 790 | 790 | Stable |

This table shows that addition of the "second" polymer improves the pourability of the product, especially after storage, due to a reduction of the viscosity drift.

TABLE 11

Effect of "second" polymer on viscosity and stability of Composition X

| "Second" Polymer Type | conc. % w/w | Viscosity mPas at 21 $s^{-1}$ | Stability |
|---|---|---|---|
| — | 0 | 1800–2200 | Stable |
| 3 | 0.05 | 1520 | Stable |
| 3 | 0.15 | 1380 | Stable |
| 3 | 0.30 | 950 | Stable |
| 3 | 0.45 | 700 | Stable |
| 3 | 0.60 | 650 | Unstable |
| 5 | 0.40 | 780 | Stable |
| 6 | 0.40 | 860 | Stable |

This table shows that incorporation of the "second" polymer lowers the viscosity with the same stability. However, too high a second polymer concentration leads to an unstable product (in this example 0.6% of "second" polymer (2)).

TABLE 12

Effect of "second" polymer on viscosity and stability of composition XI

| "Second" Polymer Type | conc. (% w/w) | Viscosity mPas at 21 $s^{-1}$ | Stability |
|---|---|---|---|
| — | 0 | 1250 | Stable |
| 2 | 0.1 | 560 | Stable |
| 3 | 0.1 | 520 | Stable |
| 4 | 0.1 | 530 | Stable |
| 5 | 0.1 | 570 | Stable |
| 6 | 0.1 | 580 | Stable |
| 2–6 | 0.2 | 360–530 | Unstable |

This table shows that incorporation of the "second" polymer improves the pourability of the products by reducing the viscosity while retaining its good stability. However, too high a "second" polymer concentration may lead to unstable products (in this particular case at 0.2% "second" polymer).

TABLE 13

Effect of "second" polymer on viscosity and stability of Composition XII

| "Second" Polymer Type | conc. % w/w | Viscosity mPas at 21 $s^{-1}$ | Stability |
|---|---|---|---|
| — | 0 | 2150 | Stable |
| 2 | 0.2 | 1060 | Stable |
| 3 | 0.2 | 790 | Stable |
| 4 | 0.2 | 800 | Stable |
| 5 | 0.2 | 760 | Stable |
| 6 | 0.2 | 700 | Stable |
| 2 | 0.3 | 580 | Stable |
| 3 | 0.3 | 420 | Stable |
| 4 | 0.3 | 430 | Stable |
| 5 | 0.3 | 520 | Stable |
| 6 | 0.3 | 520 | Stable |

This table shows that a strong viscosity reduction and hence a marked increase of product pourability is obtained on incorporation of 0.2–0.3% "second" polymer with a MW in the range of 1,200–30,000. Note that the higher MW polymers are somewhat more efficient on a weight basis.

We claim:

1. A liquid detergent composition comprising an internal active-structured phase containing detergent active material, dispersed in an aqueous phase containing dissolved electrolyte, and 0.5 to 4.5% by weight of a viscosity reducing polymer, the electrolyte containing aqueous phase being such that the polymer is dissolved therein at a level 8% to 49% by weight and the composition having a pH of 8.0 or above said composition further comprises a suspended solid particulate material selected from the group consisting solely of builders, abrasives, and bleaches and further comprising a second polymer which is different from the viscosity reducing polymer in an amount of 0.05 to 20% of the composition and having a molecular weight of 1,200 to 30,000.

2. A composition according to claim 1, which yields less than 2% phase separation upon storage at 25° C. for 21 days.

3. A composition according to claim 1, which has a viscosity no greater than 1 Pas at a shear rate of $21s^{-1}$.

4. A composition according to claim 1, wherein the viscosity reducing polymer is a co-polymer which includes an alkali metal salt of a polyacrylic, polymethacrylic or maleic acid or anhydride.

5. A composition according to claim 1, comprising from 1 to 3.5% by weight of the viscosity reducing polymer.

6. A composition according to claim 1, wherein the second polymer has an average molecular weight of at least 2,000.

7. A composition according to claim 1, wherein the second polymer has an average molecular weight of from 5,000 to 30,000.

8. A composition according to claim 1, in which the detergent active material comprises:

a) a nonionic surfactant, a polyalkoxylated anionic surfactant and mixtures thereof; and b) a non-polyalkoxylated anionic surfactant.

9. A composition according to claim 1, in which the electrolyte is present from 1 to 60% by weight of the total composition.

10. A composition according to claim 1, wherein the viscosity reducing polymer has builder properties.

11. A composition according to claim 1, in which the suspended solid particulate material comprises a water-insoluble aluminosilicate salt.

12. A composition according to claim 1, wherein the suspended particulate material comprises a substantially water-insoluble bleach.

13. A composition according to claim 1, wherein the bleach comprises disperoxydodecanediaic acid.

* * * * *